US005589917A

United States Patent [19]

Hart et al.

[11] Patent Number: 5,589,917

[45] Date of Patent: Dec. 31, 1996

[54] DONOR ROLLS WITH MAGNETICALLY COUPLED (TRANSFORMER) COMMUTATION

[75] Inventors: Steven C. Hart, Webster; Delmer G. Parker, Rochester, both of N.Y.

[73] Assignee: Xerox Corporation, Stamford, Conn.

[21] Appl. No.: 533,627

[22] Filed: Sep. 25, 1995

[51] Int. Cl.[6] ..... G03G 15/08

[52] U.S. Cl. ..... 399/274; 310/231; 310/232

[58] Field of Search ..... 355/259, 261, 355/265; 118/648; 310/219, 232, 231, 233, 236, 237

[56] References Cited

U.S. PATENT DOCUMENTS

| | | | |
|---|---|---|---|
| 3,257,224 | 6/1966 | Jons et al. | 117/17.5 |
| 3,980,541 | 9/1976 | Aine | 204/186 |
| 3,996,892 | 12/1976 | Parker et al. | 118/658 |
| 4,521,709 | 6/1985 | Saint-Michel et al. | 310/237 X |
| 4,868,600 | 9/1989 | Hays et al. | 355/259 |
| 5,172,170 | 12/1992 | Hays et al. | 355/259 |
| 5,268,259 | 12/1993 | Sypula | 430/311 |
| 5,289,240 | 2/1994 | Wayman | 355/259 |
| 5,394,225 | 2/1995 | Prker | 355/259 |

OTHER PUBLICATIONS

Hayt, William H., Jr., Engineering Electromagnetics, McGraw–Hill, 1981, p. 509. 1981.

*Primary Examiner*—Nestor R. Ramirez
*Attorney, Agent, or Firm*—John S. Wagley

[57] ABSTRACT

A donor roll for transporting marking particles to an electrostatic latent image recorded on a surface is provided. The donor roll includes a rotatably mounted body and an electrode member mounted on the body. The donor roll further includes a magnetically permeable core external to the body. The core rotates with the body. The donor roll further includes an electrically conductive material positioned on the core. The material is electrically connected to the electrode member.

19 Claims, 7 Drawing Sheets

DONOR ROLLS WITH MAGNETICALLY COUPLED (TRANSFORMER) COMMUTATION

The present invention relates to a developer apparatus for electrophotographic printing. More specifically, the invention relates to a donor roll as part of a scavengeless development process.

Cross reference is made to the following applications filed concurrently herewith: U.S. application Ser. No. 08/533,229 filed Sep. 25, 1995, entitled "Donor Rolls with Modular Commutation", by Steven C. Hart; and U.S. application Ser. No. 08/533,108 filed Sep. 25, 1995, entitled "Donor Rolls with Exterior Commutation", by Steven C. Hart et al.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al. U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein a moving donor member spaced from the surface and adapted to transport toner from the chamber of said housing to a development zone adjacent the surface, and an electrode member integral with the donor member and adapted to move therewith. The electrode member is electrically biased to detach toner from said donor member to form a cloud of toner in the space between the electrode member and the surface with toner developing the latent image. The biasing of the electrodes is typically accomplished by using a conductive brush which is placed in a stationary position in contact with the electrodes on the periphery of the donor member. U.S. Pat. No. 5,172,170 is herein incorporated by reference. The conductive brush is electrically connected with a electrically biasing source. The brush is typically a conductive fiber brush made of protruded fibers or a solid graphite brush. Typically only the electrode in the nip between the donor member and the developing surface is electrically biased. As the donor member rotates the electrode that now is in the nip needs to contact the brush. Since the distance between the nip and the developing surface is very small it is impractical to position the conductive brush in the nip. To accomplish the biasing of the donor member, the member must be extended beyond the developing surface. The donor member is typically an expensive complicated component that is very long and slender.

The use of a stationary position conductive brush in contact with the electrodes on the periphery of the donor member as a commutation method has many problems. Many materials for the contact brush have been considered including metal and non-metal materials. A carbon fiber brush and a solid graphite brush have been found to be most successful. The use of rubbing contact in the brush causes commutation electrode wear which reduces the life of the donor roll. The abrupt connection and disconnection of the brush with the respective electrode creates electrical noise and arcing between the brush and the electrode. The arcing and the rubbing between the brush and the electrodes generates heat. Toner particles located near the commutating area tend to melt and coalesce in the commutating area creating lumps of toner which negatively affect the copy quality and the reliability of the machine. Also, when a carbon fiber brush is used, the fibers continually wear and become separated from the brush. These separated fibers contaminate the intricate workings of the machine. Furthermore, contamination, such as paper and clothing fibers, which enter the copy machine, may be become trapped between the brush and the electrodes causing premature failure. More complicated filtering systems may be required to separate the paper and clothing fibers as well as agglomerates from the toner. The electrical noise generated during the commutation causes developer pulsation and ripple which adversely affect the xerographic process and are detrimental to copy quality.

The following disclosures related to scavangeless and electroded rolls may be relevant to various aspects of the present invention:

U.S. patent application Ser. No. 08/376,585
Applicant: Rommelmann et al.
Filing Date: Jan. 23, 1995

U.S. patent application Ser. No. 08/339,614
Applicant: Rommelmann
Filing Date: Nov. 15, 1994

U.S. Pat. No. 5,394,225
Patentee: Parker (Prker)
Issue Date: Feb. 28, 1995

U.S. Pat. No. 5,289,240
Patentee: Wayman
Issue Date: Feb. 22, 1994

U.S. Pat. No. 5,268,259
Patentee: Sypula
Issue Date: Dec. 7, 1993

U.S. Pat. No. 5,172,170
Patentee: Hays et al.
Issue Date: Dec. 15, 1992

U.S. Pat. No. 4,868,600
Patentee: Hays et al.
Issue Date: Sep. 19, 1989

U.S. Pat. No. 3,996,892
Patentee: Parker et al.
Issue Date: Dec. 14, 1976

U.S. Pat. No. 3,980,541
Patentee: Aine
Issue Date: Sep. 14, 1976

U.S. Pat. No. 3,257,224
Patentee: Jons et al.
Issue Date: Jun. 21, 1966

Ser. No. 08/376,585 discloses an apparatus for transporting marking particles. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

Ser. No. 08/339,614 discloses a donor roll for transporting marking particles to an electrostatic latent image recorded on a surface. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

U.S. Pat. No. 5,394,225 discloses a donor roll which has two sets of interdigitized electrodes embedded in the surface. An optical switching arrangement is located between a slip ring commutated by a brush and one set of interdigitated electrodes. The optical switching arrangement includes a photoconductive strip.

U.S. Pat. No. 5,289,240 discloses a donor roll which has two distinct sets of electrodes along the periphery of the donor roll. The roll has a first set of electrodes that extend axially the length of the roll. The first set of electrodes includes groups of 1 to 6 electrodes which are electrically interconnected to each other and are commutated by contacting the filaments of a brush which is electrically interconnected to a biasing source. The roll also has a second set of electrodes that extend axially the length of the roll, are interconnected to each other, do not contact the brush, and are grounded.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulative core made of a phenloic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

U.S. Pat. No. 3,257,224 discloses a developing apparatus including a trough to contain magnetizable developer and a magnetic roller. The roller transports the developer to an electrophotographic material and includes plates having a number of windings. The plates and windings are located inside the roll. The plates and windings serve as electromagnets to magnetically attract the developer so that it may be transported to the material.

SUMMARY OF THE INVENTION

According to the present invention there is provided a donor roll for transporting marking particles to an electrostatic latent image recorded on a surface. The donor roll includes a rotatably mounted body and an electrode member mounted on the body. The donor roll further includes a magnetically permeable core external to the body. The core rotates with the body. The donor roll further includes an electrically conductive material positioned on the core. The material is electrically connected to the electrode member.

According to the present invention, there is also provided a developer unit for developing a latent image recorded on an image receiving member to form a developed image. The developer unit includes a housing defining a chamber for storing at least a supply of toner therein and a movably mounted donor member. The member is spaced from the surface and adapted to transport toner from the chamber of the housing to a development zone adjacent the surface. The donor member includes a body and an electrode member mounted on the body. The donor member also includes an energy receiver electrically connected to the electrode member and rotatable with the donor member, a dielectric and an energy transmitter spaced from the energy receiver. The dielectric is located between the energy transmitter and the energy receiver.

According to the present invention, there is further provided an electrophotographic printing machine of the type having a developer unit adapted to develop with toner an electrostatic latent image recorded on a photoconductive member. The improvement includes a housing defining a chamber for storing at least a supply of toner in the chamber and a movably mounted donor member. The donor member is spaced from the surface and adapted to transport toner from the chamber of the housing to a development zone adjacent the surface. The donor member includes a body and an electrode members mounted on the body. The donor member also includes an energy receiver electrically connected to the electrode member and rotatable with the donor member, a dielectric and an energy transmitter spaced from the energy receiver. The dielectric is located between the energy transmitter and the energy receiver.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
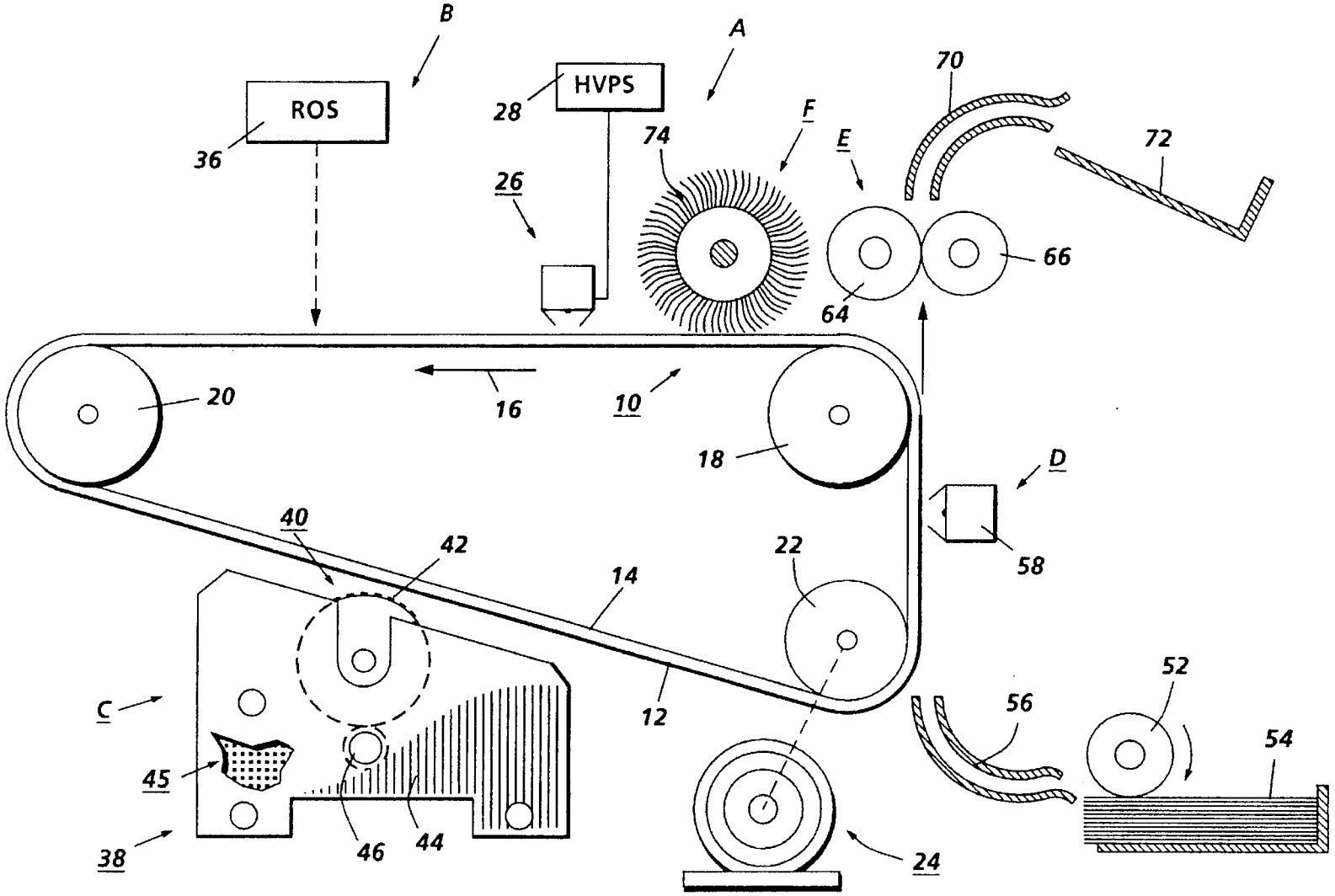
FIG. 2 is a schematic elevational view of printing machine incorporating the non contact commutation segmented donor roll of FIG. 1.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 2. At development station C, a development system 38, develops the latent image recorded on the photoconductive surface. Preferably, development system 38 includes a donor roll or roller 40 and electrical conductors in the form of embedded electrode wires or electrodes 42 embedded on the periphery of the donor roll 40. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 2, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 3:
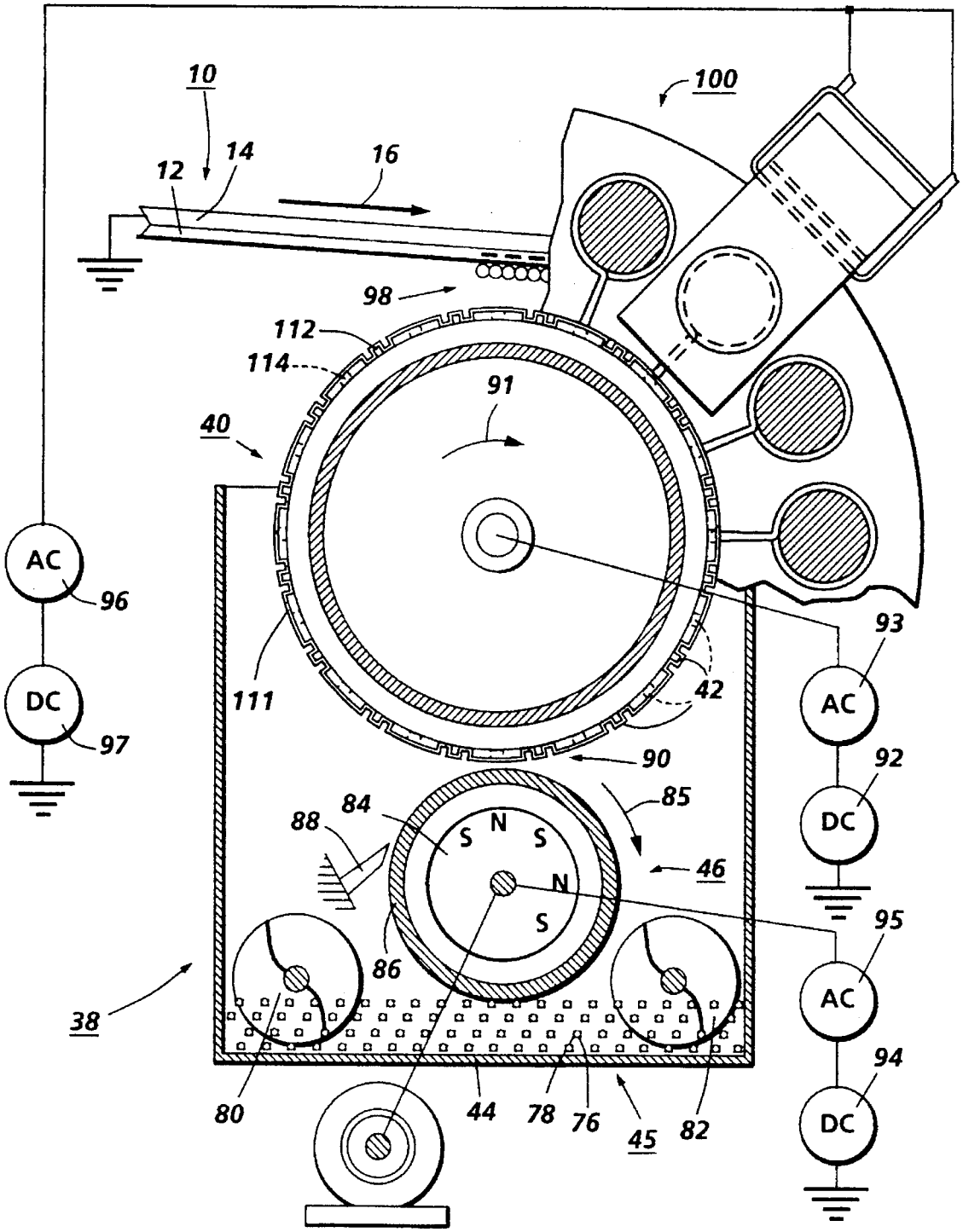
FIG. 3 is a schematic elevational view of development unit incorporating the non contact commutation segmented donor roll of FIG. 1.

Referring now to FIG. 3, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 are horizontal augers 80 and 82 which distributes developer material 45 uniformly along the length of transport roll 46 in the chamber of housing 44.

Transport roll 46 comprises a stationary multi-pole magnet 84 having a closely spaced sleeve 86 of non-magnetic material designed to be rotated about the magnet 84 in a direction indicated by arrow 85. The toner particles 78 are attached triboelectrically to the magnetic carrier granules 76 to form the developer material 45. The magnetic field of the stationary multi-pole magnet 84 draws the magnetic carrier granules 76, toward the roll and along with the granules 76, the toner particles 78. The developer material 45 then impinges on the exterior of the sleeve 86. As the sleeve 86 turns, the magnetic fields provide a frictional force to cause the developer material 45 including the carrier granules 76 to rotate with the rotating sleeve 86. This in turn enables a doctor blade 88 to meter the quantity of developer adhering to sleeve 86 as it rotates to a loading zone 90, the nip between transport roll 46 and donor roll 40. This developer material adhering to the sleeve 86 is commonly referred to as a magnetic brush.

The donor roll 40 includes the electrodes 42 in the form of electrical conductors positioned about the peripheral circumferential surface thereof. The electrodes are preferably positioned near the circumferential surface and may be applied by any suitable process such as plating, overcoating or silk screening. It should be appreciated that the electrodes may alternatively be located in grooves (not shown) formed in the periphery of the roll 40. The electrical conductors 42 are substantially spaced from one another and insulated from the body of donor roll 40 which may be electrically conductive. Half of the electrodes, every other one, are electrically connected together. Collectively these electrodes are referred to as common electrodes 114. The remaining electrodes are referred to as active electrodes 112. These may be single electrodes or they may be electrically connected together into small groups. Each group is typically on the order of 1 to 4 electrodes; all groups within the donor roll having the same number of electrodes.

Either the whole of the donor roll 40, or at least a layer 111 thereof, is preferably of a material which has sufficiently low electrical conductivity. This material must be sufficiently conductive so as to prevent any long term build up of electrical charge. Yet, the conductivity of this layer must be sufficiently low so as to form a blocking layer to prevent shorting or arcing of the magnet brush to the donor roll electrode members and/or donor roll core itself.

Embedded within the low conductivity layer 111 are the donor roll electrodes 42. As earlier stated these electrodes may be classified as common electrodes 114 or as active electrodes 112. The common electrodes 114 are all electrically connected together. The active electrodes 112 may be electrically connected into small groups of 1 to 4 electrodes.

The donor roll 40 and common electrodes 114 are kept at a specific voltage with respect to ground by a direct current (DC) voltage source 92. An alternating current (AC) voltage source 93 may also be connected to the donor roll 40 and the commons.

The transport roll 46 is also kept at a specific voltage with respect to ground by a DC voltage source 94. An AC voltage source 95 may also be connected to the transport roll 46.

By controlling the magnitudes of the DC voltage sources 92 and 94 one can control the DC electrical field created across the magnetic brush, i.e. between the donor roll surface and the surface of the rotating sleeve 86. When the electric field between these members is of the correct polarity and of sufficient magnitude, it will cause toner particles 78 to develop from the magnetic brush and form a layer of toner particles on the surface of the donor roll 40. This development will occur in what is denoted as the loading zone 90.

By controlling the magnitude and frequencies and phases of the AC voltage sources 93 and 95 one can control the magnitude and frequency of the AC electrical field created across the magnetic brush, i.e. between the donor roll surface and the surface of the rotating sleeve 86 of magnetic roll 46. The application of the AC electrical field across the magnetic brush is known to enhance the rate at which the toner layer develops onto the surface of the donor roll 40.

It is believed that the effect of the AC electrical field applied across the magnetic brush in the loading zone between the surface of the donor roll 40 and the rotating sleeve 86 is to loosen the adhesive and triboelectric bonds of the toner particles to the carrier beads. This in turn makes it easier for the DC electrical field to cause the migration of the toner particles from the magnetic brush to donor roll surface.

In the loading zone, it is also desirable to connect the active electrodes 112 to the same DC voltage source as the one to which the common electrodes 114 are connected. In this case the connection in the loading zone would be to DC voltage source 92. This has been demonstrated to improve the efficiency with which the donor roll is loaded. Additionally, it has been demonstrated that the application of AC electrical voltage to the active electrodes 112 can enhance the development efficiency.

While the development system 38 as shown in FIG. 3 utilizes donor roller DC voltage source 92 and AC voltage source 93 as well as transport roller DC voltage source 94 and AC voltage source 95, the invention may be practiced, with merely DC voltage source 92 on the donor roller.

It has been found that a value of about 200 V rms applied across the magnetic brush between the surface of the donor roll 40 and the sleeve 86 is sufficient to maximize the loading/reloading/development efficiency. That is the delivery rate of toner particles to the donor roll surface is maximized. The actual value can be adjusted empirically. In theory, the values can be any value up to the point at which arcing occurs within the magnetic brush. For typical developer materials and donor roll to transport roll spacings and material packing fractions, this maximum value is on the order of 400 V rms. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

Donor roll 40 rotates in the direction of arrow 91. The relative voltages between the donor roll 40, common electrodes 114, and active electrodes 112, and the sleeve 86 of magnetic roll 46 are selected to provide efficient loading of toner from the magnetic brush onto the surface of the donor roll 40. Furthermore, reloading of developer material on magnetic roll 46 is also enhanced. In the development zone, AC and DC electrode voltage sources 96 and 97, respectively, electrically bias electrical conductors 42 to a DC voltage having an AC voltage superimposed thereon. Electrode voltage sources 96 and 97 are electrically connectable with isolated electrodes 42. As donor roll 40 rotates in the direction of arrow 91, successive electrodes 42 advance into development nip 98, the nip between the donor roll 40 and the photoreceptor belt 10, and are electrically biased by voltage sources 96 and 97.

As shown in FIG. 3, according to the present invention, a non contact commutator 100 contacts isolated electrodes 42 in the development nip 98 and is electrically connected to electrode voltage sources 96 and 97. In this way, isolated electrodes or electrical conductors 42 advance into development nip 98 as donor roll 40 rotates in the direction of arrow 91. Isolated electrodes, i.e. electrical conductors 42, in development nip 98, are charged by the non contact commutator 100 and are electrically biased by electrode voltage sources 96 and 97. In this way, an AC voltage difference is applied between the isolated electrical conductors and the donor roll detaching toner from the donor roll and forming a toner powder cloud.

The construction and geometry of a segmented donor roll is described in detail in U.S. Pat. No. 5,172,259 to Hays et al., U.S. Pat. No. 5,289,240 to Wayman, and U.S. Pat. No. 5,413,807 to Duggan the relative portions thereof incorporated by reference herein.

Figure 1:
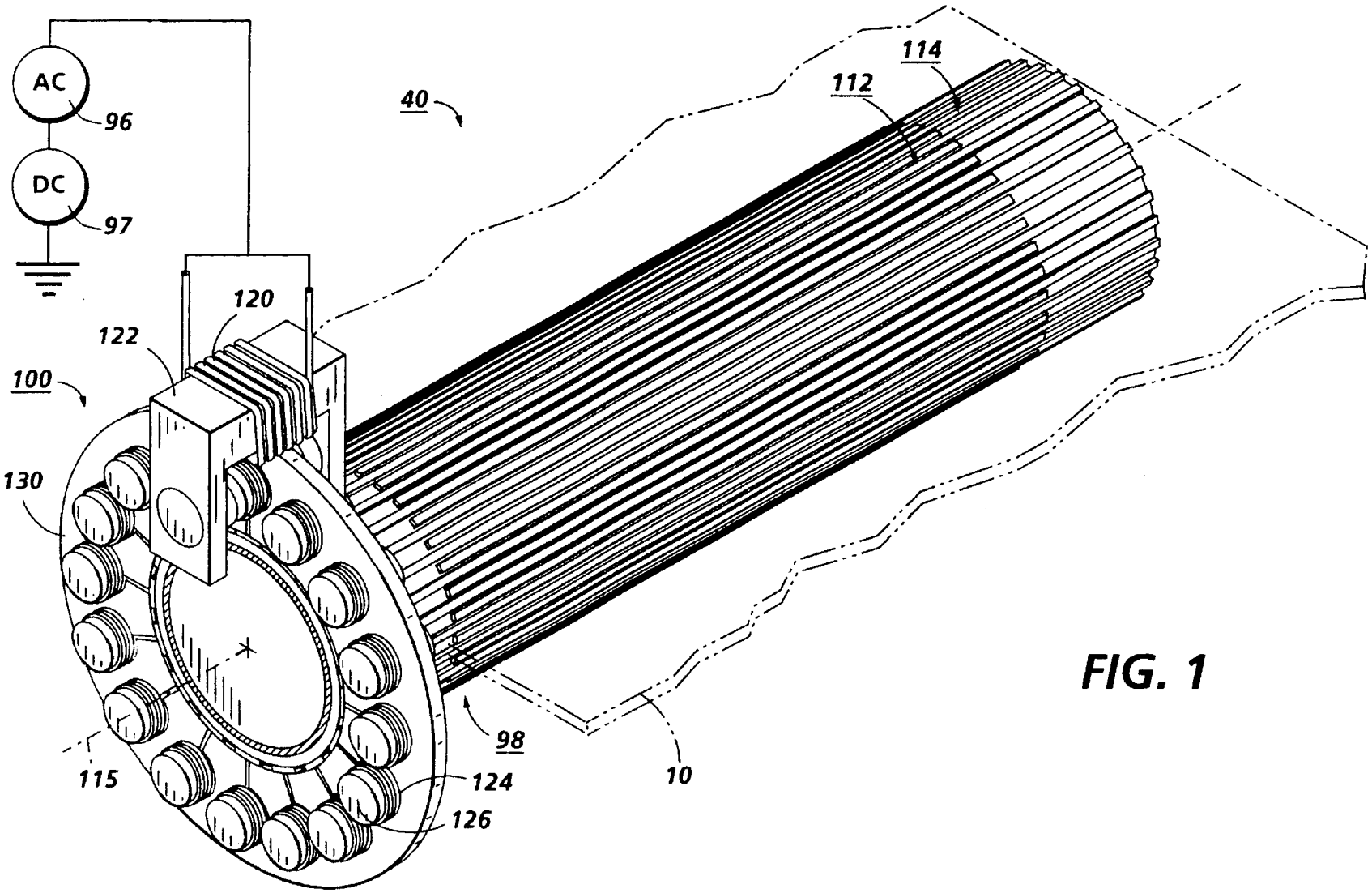
FIG. 1 is a fragmentary perspective view of a first embodiment of a non contact commutation segmented donor roll of the present invention.

According to the present invention, and referring to FIG. 1, the non-contact commutator 100 is shown. The commutator utilizes a non-contact commutation approach. The commutator 100 is essentially a transformer. A transformer includes a primary winding which couples a magnetic field into a magnetically permeable material. The time varying magnetic field in the magnetically permeable material induces an electrical voltage into a secondary winding. Like all transformers, the commutator 100 has a primary winding 120. The primary winding 120 is wrapped around a primary core 122. Like many transformers, the commutator 100 includes multiple secondary windings 124. However, unlike most transformers, the commutator 100 does not have the primary winding 120 and the secondary winding 124 wound upon a single support core or yoke. Rather, the secondary windings 124 are wrapped about a secondary core 126. The components of the commutator 100 are physically arranged so that the primary windings 120 remain stationary with respect to the development nip 98 and the developer housing 44 (see FIG. 2) while the secondary windings 124 rotate with the donor roll 40. this arrangement enables the excitation of a limited number of the secondary windings 124 at any one time.

The voltage generated in a coil is described by Lenz's law as exemplified by the following formula:

$$E=10^{-8}\times N\times[d\Phi/dt]$$

where:

E is in Volts

N is the number of turns of the coil $d\Phi/dt$ is the rate at which the flux $\Phi$ is changing with time $d\Phi/dt$ can be defined by the following formula:

$$d\Phi/dt=A[dB/dt]$$

B is the flux density in Gauss.

A is the cross section of the coil in $cm^2$.

Assuming a sinusoidally varying magnetic field with a peak flux density of $B_0$ in the coil region, for the present invention the voltage generated across the coil ends in volts is:

$$E=10^{-8}\ N\times A\times[B_0\times\text{Sin}\ \{2\times\Pi\times f\times t\}/dt]$$

Which after differentiating with respect to time yields:

$$E=10^{-8}\ N\times A\times B_0\times 2\times\Pi\times f\times[\text{Cos}\ \{2\times\Pi\times f\times t\}]$$

where:

E is in Volts

N is the number of turns in a given secondary coil

A is the cross section of a secondary coil in $cm^2$ $B_0$ is the flux density in Gauss f is the frequency in Hz t is the time in Seconds The above formula may be used to calculate the voltage available from the second winding 124.

The applicants have determined that the required bias for the donor roll 40 with the interdigitated common electrodes 114 including electrodes 42 of approximately 0.004 inches wide longitudinal electrodes which are spaced approximately 0.006 inches apart around the periphery of the donor roll 40 is approximately 1,300 volts at 3 KHz.

In order to provide the required bias of 1,300 volts, the commutator 100 must be designed with a sufficient number of turns in the secondary winding 124 and a sufficient core cross sectional area A to provide the required 1,300 volts.

Figure 4:
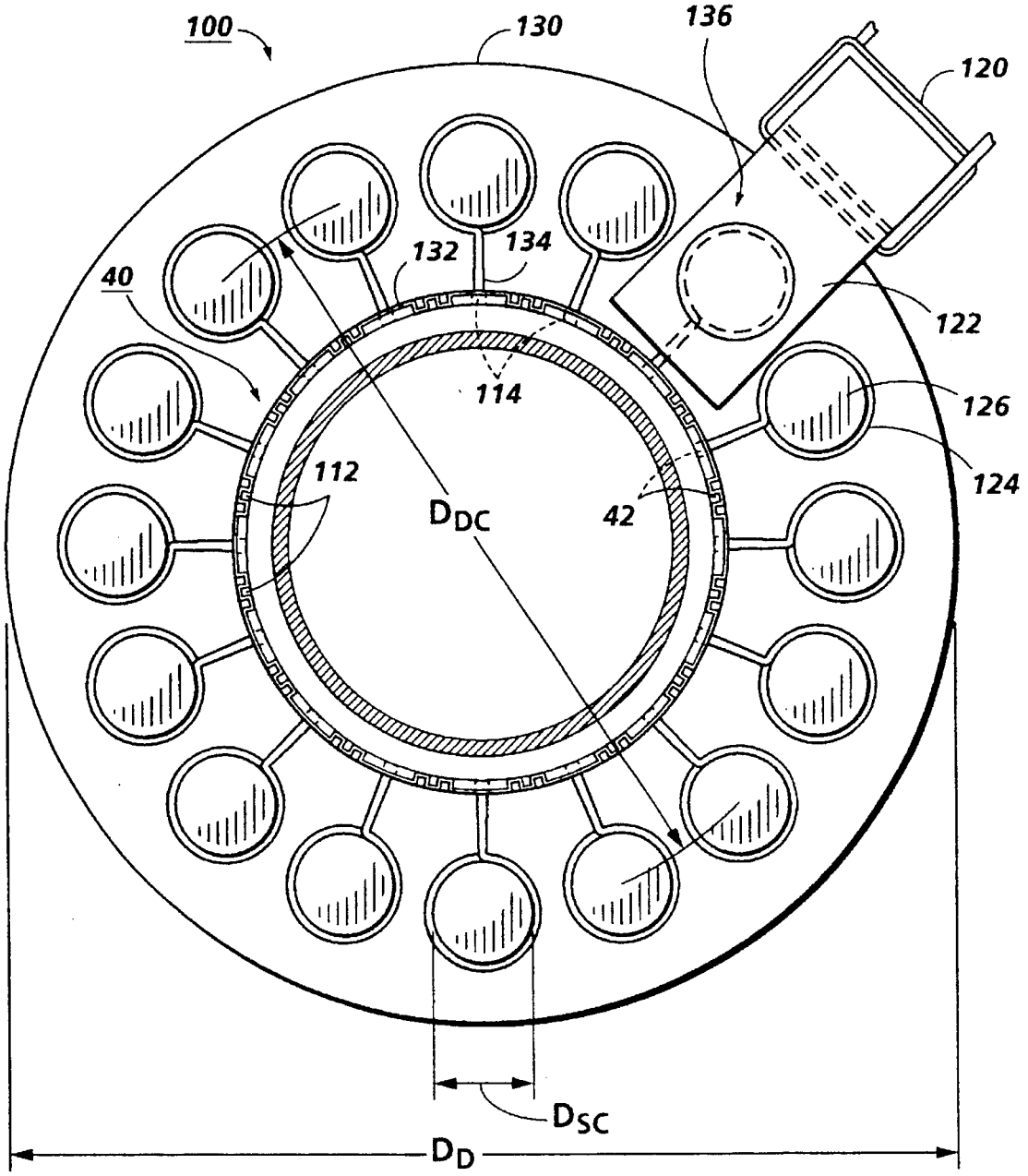
FIG. 4 is a partial frontal elevational view of the non contact commutation segmented donor roll of FIG. 1.
Figure 6:
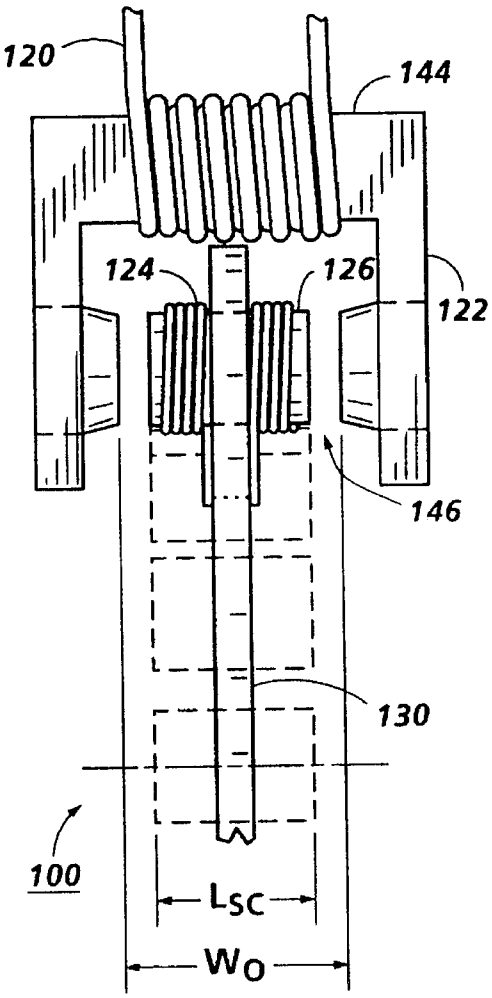
FIG. 6 is a frontal elevational view of a secondary winding for the non contact commutation segmented donor roll of FIG. 1.
Figure 5:
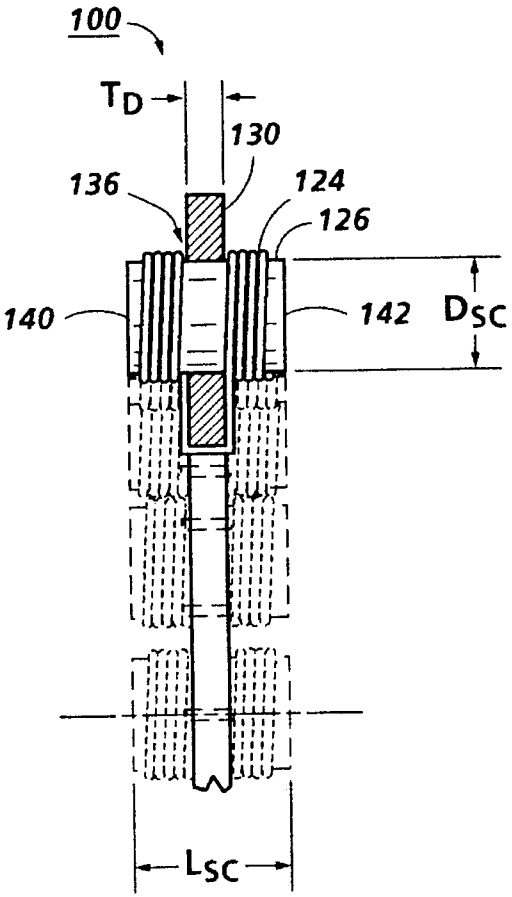
FIG. 5 is a end elevational view of the non contact commutation segmented donor roll of FIG. 1.

Referring now to FIGS. 4, 5 and 6, applicants have designed the secondary core 126 and the secondary winding or coil 124 to provide for the required 1,300 volts with the secondary core 126 being reasonably small.

Referring now to FIG. 4, the magnetically coupled commutator 100 is shown in greater detail. The secondary cores 126 are preferably held in a body 130 in the form of a ring, such as a thin disk. The disk 130 may be made of any suitable insulative material, such as a non-conductive printed circuit board.

For a donor roll with a diameter of approximately 2.5 cm, approximately 300 electrodes 42 are located around the periphery of the roll 40. Of the electrodes 42, approximately 150 are commutated active electrodes 112 while the remaining 150 electrodes are common electrodes 114. The 150 common electrodes 112 are connected to a common return (see FIG. 1). To reduce the number of secondary coils 124 required, small groups of adjoining electrodes 42, for example, three electrodes 42, are interconnected by an interconnecting pad 132. The secondary core 126 is thus electrically connected to the interconnecting pad 132 and excites the three electrically connected electrodes 42.

Metallic foil leads 134 may be applied to the disk 130 and used to interconnect the secondary coils 124 with the interconnecting pad 132. By thus interconnecting the electrodes 42, the total number of secondary coils 124 required is reduced from 150 to 50. The 50 secondary coils 124 may be further divided into two groups of 25 with each group positioned on opposite sides of the disk 130. The two opposing coils 124 on opposite sides of the disk 130 may share a common core and may be excited in parallel. To position 25 coils equally spaced about the disk 130, and to provide for sufficient voltage from the coils, the disk 130 may have a disk diameter $D_D$ equaling 13.5 cm and the cores 124 may be equally positioned about a circle having a diameter $D_{DC}$ equaling 9.5 cm. The disk has a thickness $T_D$ (see FIG. 5) sufficient to provide rigidity and strength for the respective material chosen for the disk 130.

The secondary ,windings are shown in greater detail in FIG. 5. The secondary cores 126 may be made of any suitable magnetically permeable material, such as ferrite. Alternatively, the core may be made of thin laminations of grain oriented, three percent Silicon transformer steel. The core 126 may have any suitable shape, such as square, rectangular or as shown in FIG. 5, cylindrical. To provide for the 1,300 required volts for the donor roll 40, the core 126 has a length $L_{SC}$ of approximately 20 mm and a diameter $D_{SC}$ of approximately 1.6 cm. The core 126 is preferably positioned within an opening 136 in the disk 130. Approximately half of the core 126 extends from each side of the disk 130. A pair of secondary windings 124 are wrapped about the core 126, one of the secondary windings 124 on first end 140 of the core 126 and the other secondary winding 124 located on the second end 142 of the core 126. The secondary windings 124 may be made of any suitable durable electrically conductive material, such as a metallic wire, for example, copper. The copper wire may be any suitable size, for example, the wire may be 42 gauge wire and may be coated with enamel. To provide the required 1,300 volts necessary for the donor roll 40, each secondary coil 124 includes eight layers of wire wrapped about the core 126 with 100 turns of the wire around the core 126 in each of the eight layers. Preferably, the wire is coated between adjacent coil layers with a 25 micron Mylar® (a trademark of Dupont (UK) Ltd.) insulation to prevent breakdown. The coils 124 are electrically connected to the electrodes 112 through the metallic foil leads 134 and the interconnecting pads 132.

The secondary winding 124 is shown passing through the primary core 122 in FIG. 6. The primary core 122 is made of a suitable durable magnetically permeable material, such as ferrite or alternatively transformer steel. The primary core 122 may have any suitable shape but includes an area 144 about which primary winding 120 may be wrapped and opening 146 through which the secondary windings 124 may pass. The primary core 122 as shown in FIG. 6 has a generally U-shape with the primary winding 120 wrapped about the closed end of the U and the secondary winding 124 passing through the open end of the U. The opening 146 of the primary core 122 has a width $W_O$ which is slightly larger than the length $L_{SC}$ of the core 126 about which the secondary windings 124 are wrapped. The clearance between the primary core 122 and the secondary core 126 provides for the non-contacting commutation of the present invention.

The primary winding 120 made of any suitable durable electrically conductive material, such as a metal, for example, copper. The primary winding 120 may be 42 gauge enamel coated copper wire. The primary winding 120 must have sufficient windings of sufficient diameter to provide the necessary magnetic induction in the region of the secondary coils and hence generate 1,300 volts required for the donor roll 40.

Figure 7:
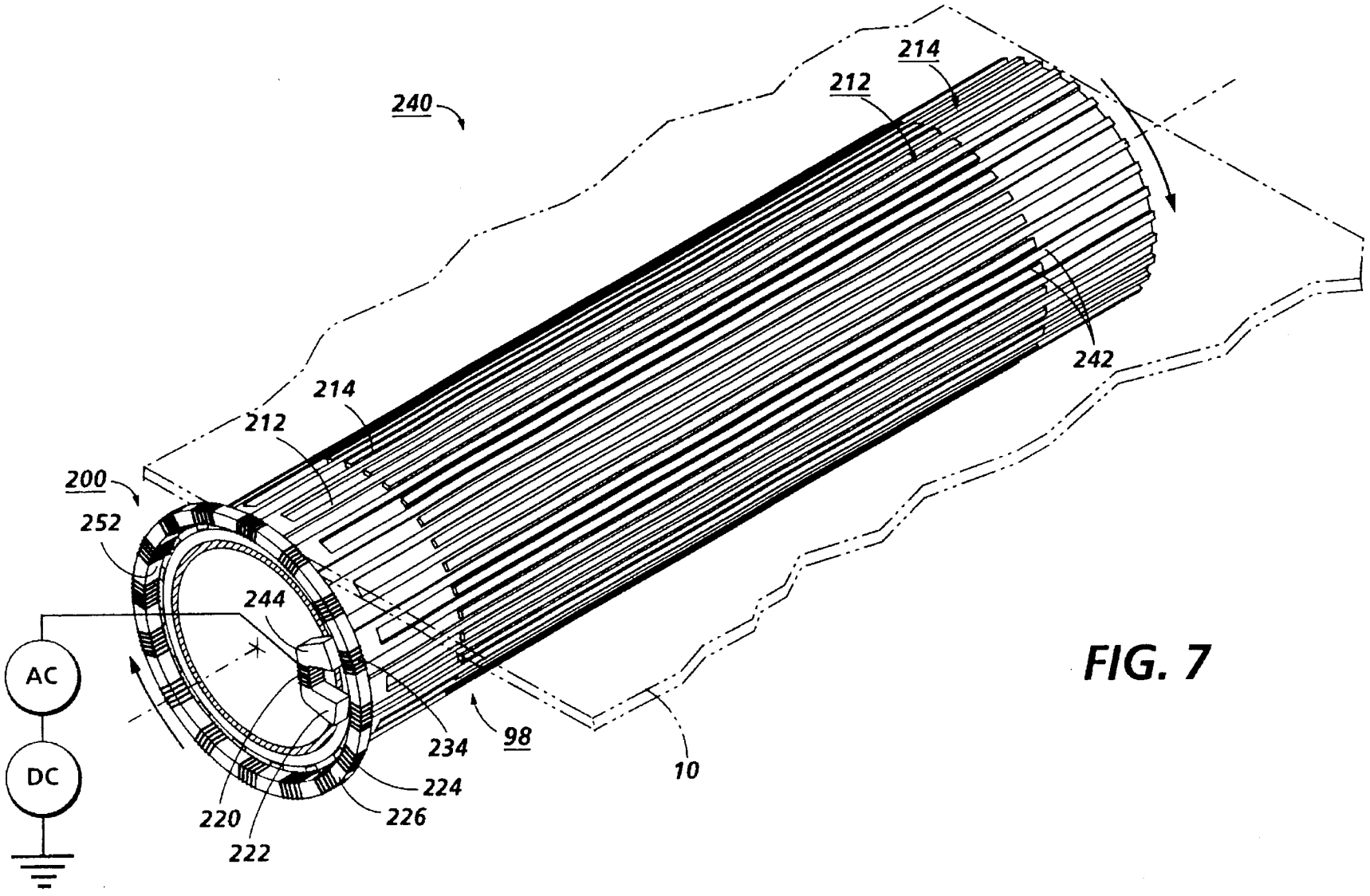
FIG. 7 is a fragmentary perspective view of a second embodiment of a non contact commutation segmented donor roll of the present invention.

Referring now to FIG. 7, an alternate embodiment of the present invention is shown in commutator 200 for donor roll 240. The commutator 200 of donor roll 240 is similar to the commutator 100 of donor roll 40 of FIG. 1 except that ring 130 with the secondary core 126 is replaced by a magnetically permeable ring 226. Like the cores 126 of FIG. 6, the secondary core 226 is positioned at an end of the donor roll 240. The secondary core 226 preferably has 50 equally spaced secondary coils 224 wrapped around the cross section of the secondary core 226. The secondary coils 224 are equally spaced around the ring 226. Each of the 50 secondary coils 224 are electrically connected by leads 234 to electrodes 242 on the periphery of the donor roll 240. The primary core 122 of the commutator 100 is replaced by the primary core 222 which is located spaced from the secondary core. This alternate embodiment of the present invention may be practiced with the primary core located either internally or externally of the secondary core. To conserve space, as shown in FIG. 7, the primary core 222 may be located internally of the secondary core 226. The primary core 222 is generally U-shaped with the open end having an arcuate shape to closely conform to inner periphery 252 of the secondary core 226. The closed end of the U-shaped core includes an area 244 about which the primary winding or coil 220 is wrapped.

Figure 8:
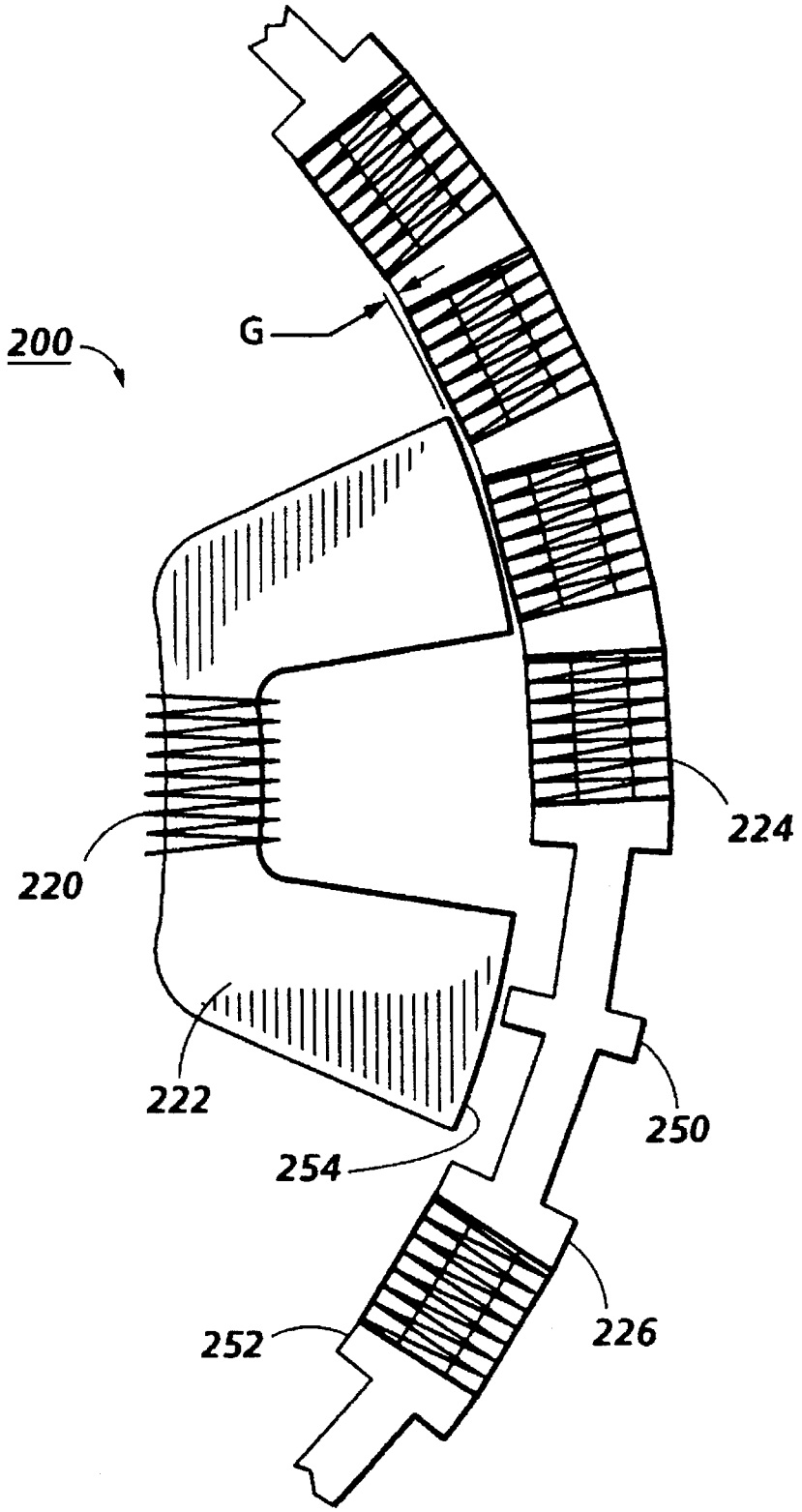
FIG. 8 is a partial end elevational view of the non contact commutation segmented donor roll of FIG. 7.

The primary core 222 and the secondary core 226 of the commutator 200 are shown in greater detail in FIG. 8. The secondary core 226 preferably includes protuberances 250 extending inwardly and outwardly in a radial direction from the secondary core 226. Each of the secondary coils 224 are positioned between adjacent protuberances. The protuberances 250 improve the efficiency of the secondary coils 224. To allow for a non-contact commutator, a gap G of 0.25 mm is provided between outer periphery 254 of the primary core 222 and the inner periphery 252 of the secondary core 226.

Since the secondary core 226 is made of a unitary magnetically conductive material, the magnetic field induced by the primary core 222 into the secondary core 226 effects all the secondary coils 224. The secondary coils 224 closest to the primary core 222 receive the greatest A/C bias. However unlike commutator 100, commutator 200 provides for a small AC voltage to be generated to secondary coils 224 and hence to all biased electrodes 212 in the periphery of the remainder of the roll 240. In particular, an AC voltage will be generated in the "loading zone" region 90 at the magnetic brush 46/donor roll 240 interface (see FIG. 3). The magnitude of this AC excitation is determined by the ratio of the arc lengths of the development zone and the remainder of the roll. The longer the remaining perimeter, the lower the AC voltage developed in the reload zone. This voltage is desirable for improving loading/reloading. This voltage is not provided for by the other embodiment of this invention.

By providing a segmented donor roll with non-contact commutation utilizing primary and secondary coils, arcing and hard electrical Ons and Offs are avoided. By utilizing the primary and secondary coils, a softer, smooth transition from zero to full applied voltage rather than the hard electrical Ons and Offs will occur as the secondary coil approaches the primary coil during rotation of the secondary coil. The electrical noise or development pulsation and ripple associated with commutating by hard electrical Ons and Offs should be small.

By providing a gap between the primary and secondary coils, contamination such as in the form of clothing and paper fibers will not affect the commutation of the donor roll.

By providing the non-contact commutation utilizing the primary and secondary coils, the heat generated at the commutating area will be greatly reduced. The reduced heat will reduce the amount of toner which is fused and forms agglomerates.

By providing clearance between the primary and secondary coils, the sliding and rubbing wear of the donor roll will be greatly reduced.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A donor roll for transporting marking particles to an electrostatic latent image recorded on a surface, comprising:

electrostatic latent image recorded on a surface, comprising:

a rotatably mounted body;

an electrode member mounted on said body;

a magnetically permeable core external to said body and rotatable therewith;

an electrically conductive material positioned on said core, said material electrically connected to said electrode member; and a second magnetically permeable core spaced from said first mentioned magnetically permeable core.

2. A developer unit for developing a latent image recorded on on a surface of an image receiving member to form a developed image, comprising:

a housing defining a chamber for storing at least a supply of toner therein;

a movably mounted donor member spaced from the surface and adapted to transport toner from the chamber of said housing to a development zone adjacent the surface, said donor member including a body, an electrode member mounted on said body, and an energy receiver electrically connected to said electrode member and rotatable with said donor member;

a dielectric; and an energy transmitter, spaced from the energy receiver with said dielectric located therebetween.

3. A developer unit according to claim 2, wherein said energy transmitter comprises a capacitive coupling.

4. A developer unit according to claim 2, wherein said energy receiver comprises a capacitive coupling.

5. A developer unit according to claim 2, wherein said energy transmitter comprises:

power source;

a magnetically permeable core; and an electrically conductive material positioned on said core and electrically connectable to said power source.

6. A developer unit according to claim 5, wherein said energy receiver comprises:

a second magnetically permeable core; and a second electrically conductive material positioned on said second magnetically permeable core and spaced from said first mentioned electrically conductive material.

7. A developer unit according to claim 6, further comprising a second electrode member mounted on said body and spaced from said first mentioned electrode member.

8. A developer unit according to claim 7, further comprising a second electrically conductive material positioned on said core and electrically connected to said second electrode member.

9. A developer unit according to claim 7, wherein said second electrode member is electrically connected to said electrically conductive material.

10. A developer unit according to claim 5, further comprising a second magnetically permeable core spaced from said first mentioned magnetically permeable core.

11. An electrophotographic printing machine of the type having a developer unit adapted to develop with toner an electrostatic latent image recorded on a photoconductive member, wherein the improvement comprises:

a housing defining a chamber for storing at least a supply of toner therein;

a movably mounted donor member spaced from the surface and adapted to transport toner from the chamber of said housing to a development zone adjacent the surface, said donor member including a body, an electrode member mounted on said body, and an energy receiver electrically connected to said electrode member and rotatable with said donor member;

a dielectric; and an energy transmitter, spaced from the energy receiver with said dielectric located therebetween.

12. A printing machine according to claim 11, wherein said energy transmitter comprises a capacitive coupling.

13. A printing machine according to claim 11, wherein said energy receiver comprises a capacitive coupling.

14. A printing machine according to claim 11, wherein said energy transmitter comprises:

power source;

a magnetically permeable core; and an electrically conductive material positioned on said core and electrically connectable to said power source.

15. A printing machine according to claim 14, wherein said energy receiver comprises:

a second magnetically permeable core; and a second electrically conductive material positioned on said second magnetically permeable core and spaced from said first mentioned electrically conductive material.

16. A printing machine according to claim 15, further comprising a second electrode member mounted on said body and spaced from said first mentioned electrode member.

17. A printing machine according to claim 16, further comprising a second electrically conductive material positioned on said core and electrically connected to said second electrode member.

18. A printing machine according to claim 16, wherein said second electrode member is electrically connected to said electrically conductive material.

19. A printing machine according to claim 14, further comprising a second magnetically permeable core spaced from said first mentioned magnetically permeable core.

* * * * *